United States Patent [19]

Ogasawara et al.

[11] Patent Number: 4,858,973

[45] Date of Patent: Aug. 22, 1989

[54] INSIDE DOOR HANDLE ASSEMBLY WITH MEANS TO PREVENT INADVERTENT SEPARATION OF DOOR HANDLE

[75] Inventors: Shinji Ogasawara, Hekinan; Yukio Isomura, Chiryu; Souichiro Okudaira, Toyota, all of Japan

[73] Assignees: Aisin Seiki Kabushiki Kaisha; Toyota Jidosha Kabushiki Kaisha, both of Japan

[21] Appl. No.: 197,920

[22] Filed: May 24, 1988

[30] Foreign Application Priority Data

May 27, 1987 [JP] Japan ..... 62-80405[U]

[51] Int. Cl.[4] ..... E05B 3/00

[52] U.S. Cl. ..... 292/347; 292/DIG. 31

[58] Field of Search ..... 292/173, 347, DIG. 31

[56] References Cited

U.S. PATENT DOCUMENTS 3,508,778 4/1970 Legge et al. ..... 292/DIG. 31 X
4,365,831 12/1982 Bourne ..... 292/DIG. 31 X
4,580,822 4/1986 Fukumoto ..... 292/DIG. 31 X

FOREIGN PATENT DOCUMENTS 59-190849 12/1984 Japan .

*Primary Examiner*—Nicholas P. Godici
*Assistant Examiner*—William Scott Andes
*Attorney, Agent, or Firm*—Finnegan, Henderson, Farabow, Garrett & Dunner

[57] ABSTRACT

A inside door handle assembly for an automotive vehicle includes a bezel fixedly secured to a door, a handle freely rotatably retained by opposing side walls of the bezel, an arm integral with the handle on one side of the two opposing side walls of the bezel, a spring arranged on the handle and having one end fixedly engaged with the bezel and another end fixedly engaged with the handle, the spring biasing the handle at all times in a direction for closing the door, and an engagement portion integral with the handle on the other side of the two opposing side walls of the bezel, the engagement portion coming into abutting contact with the spring when the handle is turned in a direction which opens the door.

3 Claims, 3 Drawing Sheets

INSIDE DOOR HANDLE ASSEMBLY WITH MEANS TO PREVENT INADVERTENT SEPARATION OF DOOR HANDLE

BACKGROUND OF THE INVENTION

This invention relates to an inside door handle assembly for automotive vehicles.

An example of an inside door handle assembly according to the prior art is as disclosed in the specification of Japanese Utility Model Application Laid-Open (KOKAI) No.59-190849. This conventional assembly includes a bezel secured to a side door of an automotive vehicle, and a handle held by opposing side walls of the bezel so as to be capable of being pivoted back and forth. The handle is formed to include an arm disposed on one side of the opposing side walls of the bezel. The handle is biased at all times by a spring in a direction which will keep the door in a closed state. When the door is opened, the user rotates or turns the handle against the biasing force of the spring until the arm abuts against a stop, which limits the turning angle of the handle provided in the bezel.

In order to open the door with this conventional inside door handle assembly, a force is applied to the handle to turn the same. Though the handle arm and the stop are held in abutting contact on one side of the opposing side walls of the bezel when the handle is thus turned, the handle is free on the other side and therefore can be twisted under the opening force. As a result, there is the danger that the handle will become detached from the bezel when turned.

SUMMARY OF THE INVENTION

An object of the present invention is to provide an inside door handle assembly in which the handle will twist relative to the bezel when turned.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the door handle assembly of this invention comprises a bezel fixedly secured to a door and having two opposing side walls, a rotatable handle retained by the opposing side walls of the bezel, an arm formed as an integral part of the handle adjacent one of the two opposing side walls of the bezel, a spring arranged on the handle and having a first end engaged with the bezel and a second end engaged with the handle, the spring biasing the handle at all times in a direction for closing the door, and an egagement portion formed as an integral part of the handle adjacent the other of the two opposing side walls of the bezel, the engagement portion coming into abutting contact with the spring when the handle is turned in a direction which opens the door.

When the handle is turned to open the door, the arm of the handle and the stop are held in abutting contact on one side of the opposing side walls of the bezel, while the engagement portion of the handle and the spring are held in abutting contact on the other side of the opposing side walls of the bezel. When the handle is turned, therefore, it will not twist relative to the bezel and, hence, will not become detached from the bezel.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

An preferred embodiment of the present invention will now be described with reference to the drawings.

Figure 1:
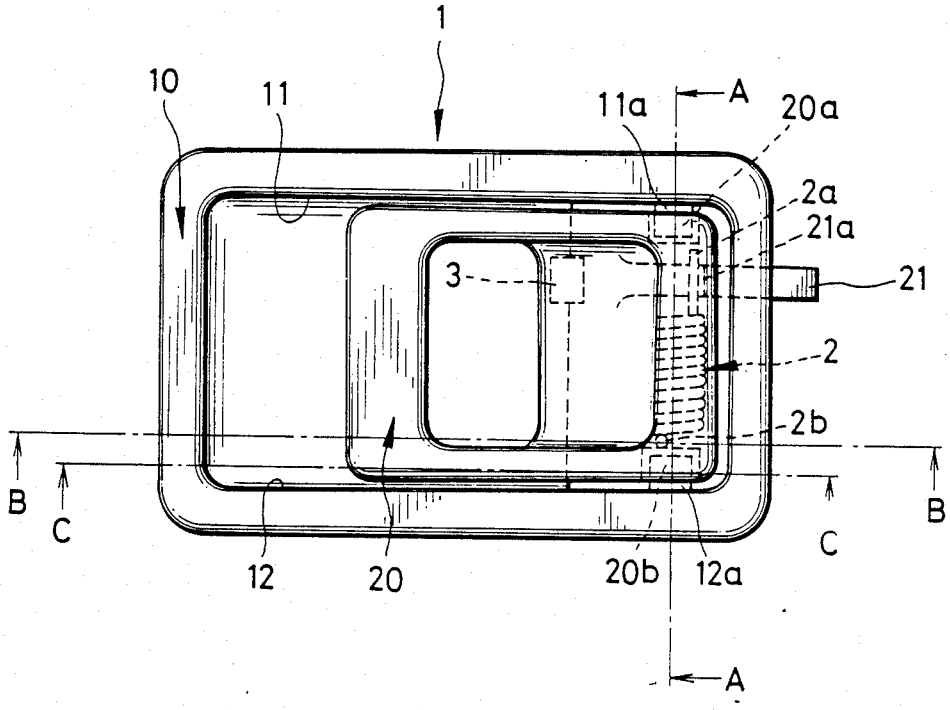
FIG. 1 is a plan view illustrating a preferred embodiment of an inside door handle constructed according to the present invention.
Figure 2:
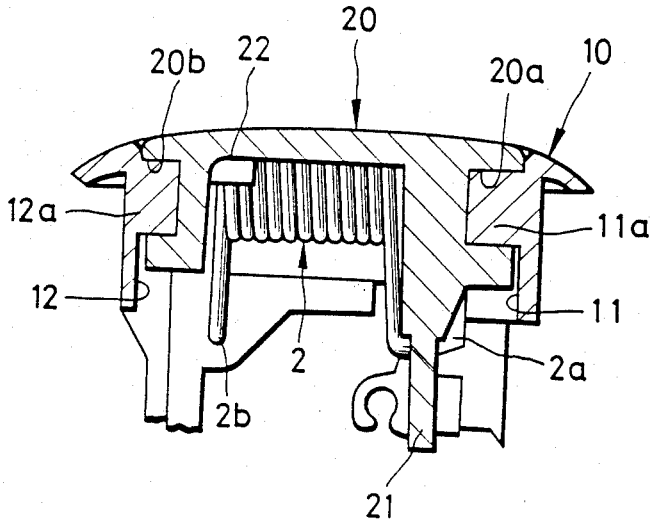
FIG. 2 is a sectional view taken along line A—A of FIG. 1.
Figure 3:
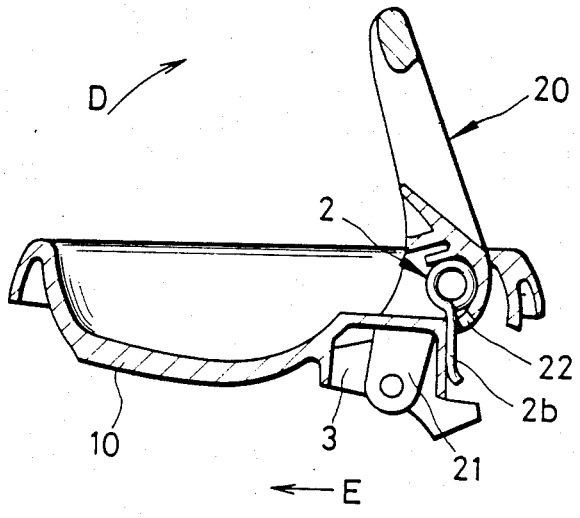
FIG. 3 is a sectional view taken along line B—B of FIG. 1.
Figure 4:
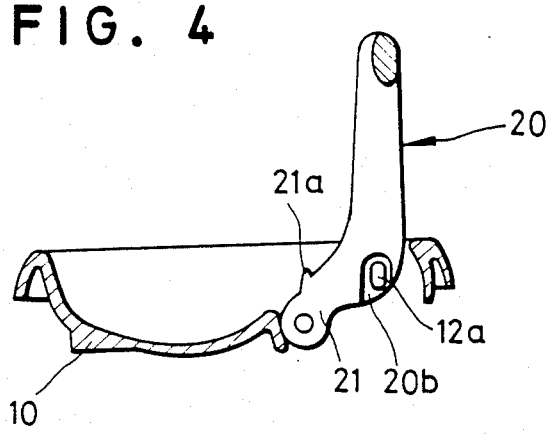
FIG. 4 is a sectional view taken along line C—C of FIG. 1 and shows the assembly before installation of a stopper.

As shown in FIGS. 1 through 3, an inside door handle 1 in accordance with the invention includes a bezel 10 secured to a vehicle door (not shown), and a handle 20 pivotally supported in the bezel 10 via a spring 2 so as to be turnable back and forth. The bezel 10 has opposing longitudinal side walls 11, 12 formed to include respective projections ll*a*, 12*a*. The handle 20 is provided at one end with grooves 20*a*, 20*b* fitted into the projections ll*a*, 12*a*, respectively. The handle 20 is thus pivotally supported in the bezel 10 and can be turned back and forth about the projections ll*a*, 12*a*. As shown in FIG. 4, the grooves 20*a*, 20*b* of handle 20 are so adapted that when the handle 20 is turned until it is substantially at right angles to the bezel 20, the openings of the grooves 20*a*, 20*b* will be centered on the respective projections ll*a*, 12*a* of the bezel 10. In other words, when the handle 20 is mounted on the bezel 10, the handle 20 is inserted into the bezel 10 in a state where it is substantially at right angles to the bezel, and the projections ll*a*, 12*a* are then mated with the grooves 20*a*, 20*b*, respectively.

Figure 5:
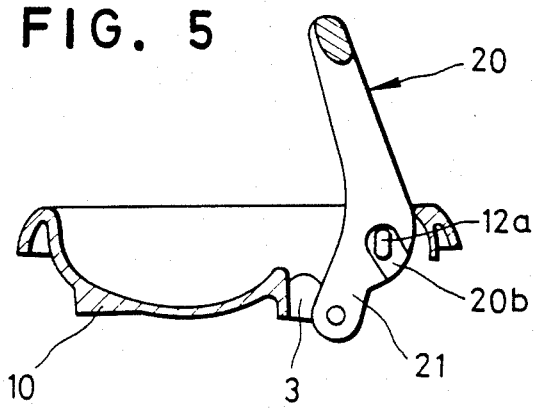
FIG. 5 is a sectional view taken along line C—C of FIG. 1 and shows the assembly after installation of a stopper.

The handle 20 is formed to have an arm 21 on the side of the groove 20*a*. A rod (not shown) is connected to the arm and is coupled to a well-known door lock device (not shown). The spring 2 is disposed on the handle 20 and has one end 2*a* held on a projection 21*a* provided on the arm 21 of handle 20, and another end 2*b* held on the bezel 10. The handle 20 is biased by the spring 2 at all times in a direction which keeps the door closed. Provided on the side 11 of the opposing side walls of bezel 10 is a stop 3 which is abutted by the arm 21 of handle 20 when the handle is turned, thereby limiting the angle through which the handle 20 rotates. The stop 3 is mounted in the bezel 10 after the handle 20 is attached to the bezel. As shown in FIG. 5, the stop 3 limits the rotation of the handle 20 in such a manner that the handle 20 will not be able to be turned to an attitude at which it is substantially at right angles to the bezel 10. This assures that the grooves 20*a*, 20*b* of handle 20 will not disengage from the respective projections 11*a*, 12*a* of bezel 10, thereby preventing the handle 20 from becoming detached from the bezel 10.

Figure 6:
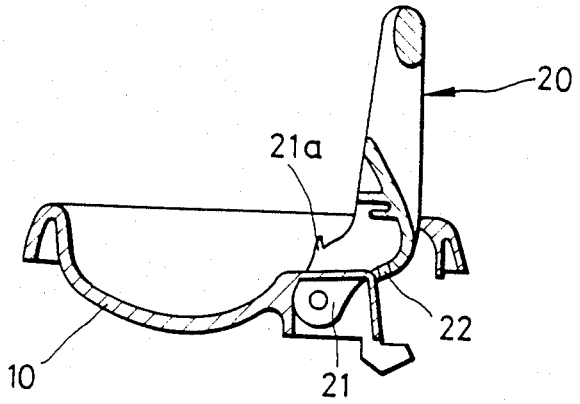
FIG. 6 is a sectional view showing a handle being mounted in a bezel.

According to a feature of the present invention, and as shown in FIGS. 1 through 3, an engagement portion 22 is integrally provided on the handle 20 on the side of the groove 20*b* of the handle. The arrangement is such that when the handle 20 is turned, the engagement portion 22 abuts against the other end 2*b* of spring 2. As shown in FIG. 6, the engagement portion 22 is provided on the handle 20 in such a manner that it will not interfere with the bezel 10 when the handle 20 is installed in the bezel.

In operation, the user turns the handle 20 in the direction of arrow D in FIG. 3, thereby moving the arm 21 of handle 20 in the direction of arrow E to pull the aforementioned rod. It should be noted that the handle 20 turns until the arm 21 abuts against the stop 3 on the side of groove 20*a* of handle 20 and the engagement portion 22 abuts against the other end 2*b* of the spring 2 on the side of groove 20*b* of handle 20. Owing to movement of the rod, the door lock device coupled to the rod is actuated to open the door. The user may thus push the door away from the passanger compartment to swing the door open. At this time the handle 20 is restored to its initial position, namely the position which prevails when the door is closed, by the biasing force of the spring 2. By pulling the door toward the passenger compartment, the user can close the door.

Thus, by turning the handle 20, the arm 21 abuts against the stop 3 on the side of groove 20*a*, and the engagement portion 22 abuts against the end 2*b* of spring 2 on the side of groove 20*b*. As a result, the handle 20 cannot twist relative to the bezel 10. This assures that the handle 20 will not become detached from the bezel 10.

As many apparently widely different embodiments of the present invention can be made without departing from the spirit and scope thereof, it is to be understood that the invention is not limited to the specific embodiments thereof expect as defined in the appended claims.

What we claim is:

1. An inside door handle assembly, comprising:

a bezel fixedly secured to a door and having two opposing side walls;

a rotatable handle retained by the opposing side walls of said bezel;

an arm formed as an integral part of said handle adjacent one of the two opposing side walls of said bezel;

a spring arranged on said handle and having a first end engaged with said bezel and a second end engaged with said handle, said spring biasing said handle at all times in a door closing direction;

a stop provided adjacent said one of the two side walls of said bezel, said stop coming into abutting contact with said arm when said handle is turned in the door opening direction; and an engagement portion provided as part of said handle adjacent the other of the two opposing side walls of said bezel, said engagement portion coming into abutting contact with said spring when said handle is turned in a direction which opens the door.

2. An inside door handle assembly according to claim 1, having grooves formed at one end of said handle and first and second projections formed respectively on said opposing side walls, wherein said projections are inserted into or released from said grooves of said bezel only when said handle is positioned at a right angle with respect to said bezel.

3. An inside door handle assembly according to claim 2, wherein said arm of said handle is provided with a third projection and the second end of said spring is engaged with said third projection.

* * * * *